United States Patent [19]

Suzuki et al.

[11] Patent Number: 4,796,046

[45] Date of Patent: Jan. 3, 1989

[54] COPY MACHINE TONER FIXING DEVICE

[76] Inventors: Hirosuke Suzuki, 21-8 Kotesashi-Machi 4-chome, Tokorozawa-shi, Saitama; Etsuo Yamazaki, 2-34 Toyooka 5-chome, Iruma-#8 Shi, Saitama; Yoshiaki Sato, 322 Umahikizawa Hitaka-machi, Iruma-gun, Saitama, all of Japan

[21] Appl. No.: 830,949

[22] Filed: Apr. 30, 1986

Related U.S. Application Data

[63] Continuation of Ser. No. 585,277, Mar. 1, 1984, abandoned.

[51] Int. Cl.[4] ..... G03G 15/20

[52] U.S. Cl. ..... 355/3 FU; 355/3 R; 355/14 FU; 219/216

[58] Field of Search ..... 355/3 FU, 14 FU, 3 TR; 118/60, 101; 219/469, 471, 216; 432/60; 29/132

[56] References Cited

U.S. PATENT DOCUMENTS

| | | | |
|---|---|---|---|
| 121,010 | 2/1946 | Joyce, Jr. et al. | 174/110.6 |
| 3,941,635 | 3/1976 | Travelle et al. | 29/132 |
| 3,962,153 | 6/1976 | Gore | 260/2.5 R |
| 4,149,797 | 4/1979 | Imperial | 355/3 FU |
| 4,257,699 | 3/1981 | Lentz | 355/3 FU |
| 4,309,591 | 1/1982 | Kanoto et al. | 219/471 X |
| 4,309,803 | 1/1982 | Blaszak | 355/3 R X |
| 4,324,482 | 4/1982 | Szlucha | 355/3 FU |
| 4,329,565 | 5/1982 | Namiki et al. | 355/3 FU X |
| 4,372,246 | 2/1983 | Azar et al. | 355/3 FU X |
| 4,522,866 | 6/1985 | Nishikawa et al. | 29/132 X |
| 4,562,335 | 12/1985 | Katsuno et al. | 355/3 FU X |

FOREIGN PATENT DOCUMENTS 0165719 12/1985 European Pat. Off. .

*Primary Examiner*—A. C. Prescott
*Assistant Examiner*—Jane Lau

[57] ABSTRACT

A copy machine toner fixing device is provided having a plurality of rollers in which adjacent rollers are in contact under pressure, wherein at least one of the rollers is covered with a non-adhesive coating layer and copy paper carrying toner images thereon is passed between the rollers to fix the toner images on the paper, characterized in that the coating layer is an open celled, cellular plastic film wound around the periphery of the roller. A preferred film is expanded, porous polytetrafluoroethylene. The outer surface of the coating layer may advantageously be rendered non-porous by application of compression forces externally to the coating layer. Electroconductive filler may be advantageously incorporated into the open celled plastic film.

9 Claims, 2 Drawing Sheets

COPY MACHINE TONER FIXING DEVICE

This is a continuation of application Ser. No. 585,277, filed Mar. 1, 1984, now abandoned.

BACKGROUND OF THE INVENTION

This invention concerns a roller fixing device for use in an electronic copying machine, particularly adapted to prevent the occurrence of off-set phenomena due to the migration of toner images on a heat fixing roller of the electronic copying machine, and enables the efficient fixing of toner by reducing the temperature rise time of the heating roller, as well as enabling one to obtain a clear copy product with little or no luster in the toner images after fixing.

In an electronic copying machine intended for dry reproduction, a fixing method has generally been employed in which toner images formed electrostatically or magnetically on copy paper are passed between two rotating rollers in contact with each other under pressure, and one or both of the rollers is heated from the inside.

This fixing process using the above-mentioned method has various advantages such as ease in the rapidity and high heat efficiency compared with other types of fixing methods and, accordingly, this roller-fixing method has been utilized in most electronic copying machines presently in use. However, because toner images on copy paper are compression-contacted in a heat-fused stated to the circumferential surface of the heated roller, a so-called "off-set phenomenon" results, wherein toner images may partially be deposited and caused to migrate on the circumferential surface of the roller, or the deposited toner images migrate to the other roller and can be retransferred to develop on the next copy paper, thereby contaminating the same. In order to prevent such a deposition on the toner images, the heat and/or press roller, which generally are made of metals such as stainless steel and aluminum, are coated at their surfaces with a non-adhesive thin film made of a material which has excellent release characteristics with respect to the toner images. For example, fluoro resins such as polytetrafluoroethylene (PTFE), tetrafluoroethylene-hexafluoropropylene copolymer (FEP) have been used, or silicone resins, which are coated directly on the metal roller, or after previously coating the roller with rubber-like elastic material such as synthetic rubber as a buffer layer.

Conventional methods of forming the non-adhesive thin film on the roller surface includes a method of preparing a heat-shrinkable tube made of the foregoing FEP resin, fitting the heat-shrinkable tube over the roller, and then shrinking the same under heating to apply a coating. A method of coating the above-mentioned PTFE resin by applying a liquid dispersion, solution or powder to the roller, carrying out baking the applied coating and, thereafter, forming a non-adhesive thin film by means of surface lapping or the like.

In the case where the thin film is formed by such a method, it generally results in a problem, in that the heat conductivity of the heated roller is reduced thereby lessening the stability in the temperature on the roller surface. The roller may not function well as a fixing roller in view of the non-adhesiveness, luster may be produced on the copy products affecting their appearance, or clear copies can not be obtained.

The method using a heat-shrinkable tube suffers from the problem that there is a limit in the thickness of the heat shrinkable tube as a result of the method of its production to render it difficult to further reduce the film thickness and, accordingly, the heat conductivity of the heat roller is lessened requiring a much greater time for the temperature to increase on the roller surface, thereby retarding the fixing. This also provides the drawback of increased production costs due to the use of the heat-shrinkable tube.

If the surface hardness of the fixing roller (heat and/or press roller) is high, fused toners are liable to be compressed excessively upon pressurization resulting in luster in the toner images, thereby affecting the appearance of the copy or, in an extreme case, the profile of the toner images is blurred. In view of the above, although it has been attempted to dispose a resilient material such as a silicone rubber as a buffer layer between the metal roller and the heat-shrinkable tube, such a combination has not yet provided fully acceptable results effect because of the large minimum thickness of the heat-shrinkable tube, leaving room for further improvement.

In the other case where the above-mentioned PTFE resin is coated as a liquid dispersant, solution or powder onto the roller to form a thin, non-adhesive film through baking or the like, the inherent non-adhesiveness of the resin is significantly reduced on baking and, therefore, there is a problem in view of the lessened releasability of the toner during long use and it suffers from lessened durability.

SUMMARY OF THE INVENTION

A roller fixing device is provided having a plurality of rollers in which adjacent rollers are in contact under pressure with respect to each other, at least one of the rollers being provided at the outer surface thereof with a nonadhesive coating layer, and copy paper carrying toner images thereon can be passed between this plurality of rollers to thereby fix toner images on the paper, wherein the coating layer is a porous film of open cell cellular plastic wrapped about at least one of the rollers. The coating layer can be helically wrapped about the roller or longitudinally wrapped along the axial direction of the roller. The plastic film may contain electroconductive filler material. The open cellular plastic film is preferably an oriented film of porous, expanded polytetrafluoroethylene. The coating layer can be rendered non-porous near the region of its external surface but otherwise be porous or it can be rendered nonporous throughout. The coating layer preferably has a thickness of less than 0.15 millimeters.

DETAILED DESCRIPTION OF THE INVENTION AND PREFERRED EMBODIMENTS WITH REFERENCE TO THE DRAWINGS

A copy machine toner fixing device is provided having a plurality of rollers in which adjacent rollers are in contact under pressure, wherein at least one of the rollers is covered with a non-adhesive coating layer and copy paper carrying toner images thereon is passed between the rollers to fix the toner images on the paper, characterized in that the coating layer is an open celled, cellular plastic film wound around the periphery of the roller. A preferred film is expanded, porous polytetrafluoroethylene. The outer surface of the coating layer may advantageously be rendered nonporous by application of compression forces externally to the coating layer. Electroconductive filler may be advantaegously incorporated into the open celled film.

This invention has been made in view of the drawbacks in the prior art and it is an object of the invention to provide an inexpensive roller fixing device in which little or no off-set results even after long use in an electronic copying machine. The time required for the starting operation is shortened by the improvement in the heat conductivity of the roller of this invention and the copy products have little or no luster and clear and excellent in the durability. In view of the above, in a fixing roller device having a plurality of roller in which adjacent rollers are in contact under pressure with each other, at least one of the rollers is provided at the outer surface thereof with a non-adhesive coating layer. Copy paper carrying toner images thereon is passed between said rollers to fix the toner images on said paper. The coating layer is applied by wrapping an open cell cellular plastic film around the steel roller such that the thickness of the coating layer is reduced over conventional coatings to improve the heat conductivity thereof and, as a result, the time required for starting is reduced leading to energy saving. Because the reduction in the thickness of the coating layer does not impair the elasticity of a rubbery elastic material when it is disposed as a buffer layer on the surface of the metal roller, aimed at providing a moderate pressurization, the surface hardness of the heat and/or press roller can be reduced and, as a result, luster on the toner images can be substantially eliminated to provide clear copy products.

Because the non-adhesive coating layer of this invention is formed by winding a plastic film about the steel roll, this device can be produced at reduced cost as compared to the case of using a heat-shrinkable tube. Moreover, because no reduction in the non-adhesiveness results, the off-set phenomenon can be substantially eliminated, even after a long time of use.

Figure 1:
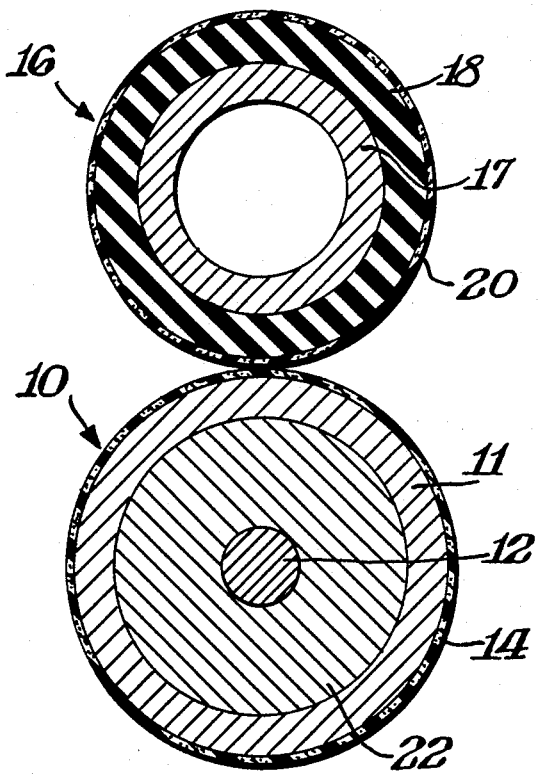
FIG. 1 is a cross-sectional view of covered rollers for fixing toner in a preferred embodiment in accord with this invention.

This invention can be described in detail referring to the accompanying drawings, but this invention is, of course, not limited to those examples. Various modifications or combinations are possible within the scope of the technical concepts of this invention. For example, disposition of an inner heater to each of the rollers, disposition of a buffer layer made of a resilient material to each of the rollers, or provision of the non-adhesive coating layer only to one press roller are contemplated. A roller fixing device according to this invention is adapted, for instance, as shown in FIG. 1 such that a heated roller 10 having a heat source, 12, such as a quartz tube heater, contained in the inside of the roller main body 11 made of copper, aluminum or the like and having a non-adhesive coating layer 14 prepared by wrapping an open cell cellular plastic film about the outer circumferential surface of the roller main body 11 and press roller 16 having a resilient material 18 made of a relatively thick silicone rubber, or the like, as a buffer layer affixed to the outer circumferential surface of a metallic roller main body 17 and further having a coating layer 20 on the outer circumferential surface thereof prepared by winding an open cell cellular plastic film, are supported in a state of contact under pressure as to each other and they are rotationally driven by a motor, not shown. The heat roller 10 is heated by the heat source 12 upon operation of the fixing device and the heating temperature is controlled depending on the kind of toners employed.

The open cell cellular plastic film can be affixed to the roll by coating an adhesive on the outer circumferential surfaces of the roller main body 11 and the resilient material 18, or by directly winding the heat fusible plastic layer or the like after the formation thereof. It may be disposed onto an intervening layer, for instance, made of another fluororesin, e.g., PTFE and FEP as an under layer. If required, the surface of the tape to be bonded may be applied with a surface treatment using a surface treating agent or a corona discharging device.

The open cell cellular plastic films usable herein include those films having non-adhesive properties and a certain heat-resistance, for example, those films having a cellular micro-structure in which a plurality of fine open cells are formed as the inner structure which are prepared, for instance, from fluororesins such as polytetrafluoroethylene resin (PTFE), tetrafluoroethylenehexafluoropropylene copolymer (FEP), tetrafluoroethylene-perfluoroalkylvinyl ether copolymer (PFA), or olefin resins such as polyethylene and polypropylene, by way of known processes such as stretching, salt leaching, solvent evaporization and sintering. Among all, stretched, expanded open cell cellular tetrafluoroethylene resin film (EPTFE) is preferred in view of the non-adhesiveness, heat resistance, etc.

EPTFE is produced, for instance, by the process as described in Japanese Patent Publication No. 51-18991, which is a porous member having a micro-structure in which fine nodes are connected to each other by a plurality of fibrils and the fibrils are separated from each other by pores. This is best suited as the coating layer because it has a high prosity (40–99%) and a high strength (matrix tensile strength exceeding 514 kg/cm$^2$) and is further excellent in flexibility.

Figure 2:
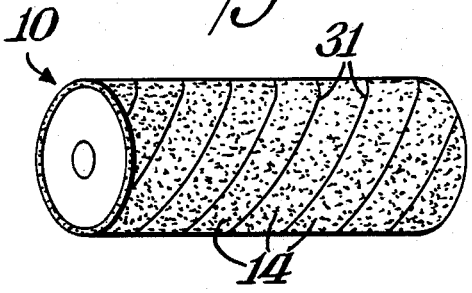
FIGS. 2 and 3 are two alternate pictorial views of different fixing rollers according to the invention.
Figure 3:
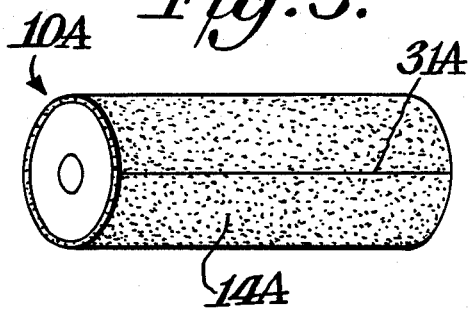

The open cell cellular plastic film 14 can be wound, for instance, as shown in FIG. 2, by wrapping the same helically or, as shown in FIG. 3, by wrapping the film 14A longitudinally about the axis of the roller. In these cases, it is not always necessary to abut the side edges of the plastic films 14 or 14A to each other but the side edges 31 or 31A may be overlapped to each other. Specifically, because the open cell cellular plastic film used in this invention has an open cell structure, it can be deformed under pressure and, consequently, the overlapped portion of the film can be rendered smooth after winding the film, for instance, by means of rotating the same while the abutment with a compression roll having a hard surface.

Figure 4:
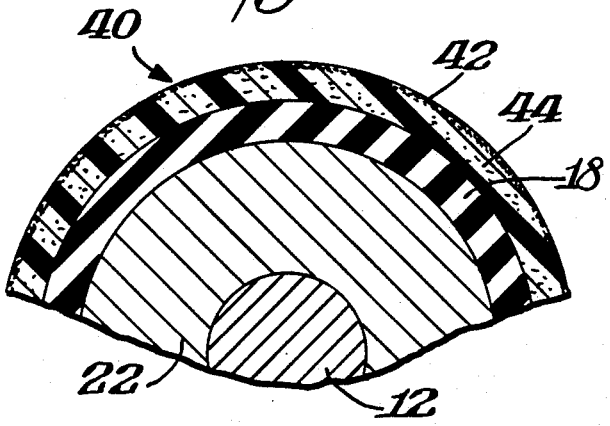
FIG. 4 shows a cross section of a fixing roller having an outer covering thereon, applied to a rubber underlayer, the outer covering comprising a partly porous, partly nonporous PTFE fluorocarbon polymer.

In a preferred embodiment according to the invention, a coating layer of open cell cellular plastic film is applied to a roller and external compression is applied, such as by a pressure roller, to compress the coating and make it nonporous near the external surface thereof and porous near the internal surface thereof. FIG. 4 shows such a coating 40 having nonporous outside portion 42 and porous inside portion 44, the covering applied over a slicone buffer layer 18 affixed over steel roller 22.

Figure 5:
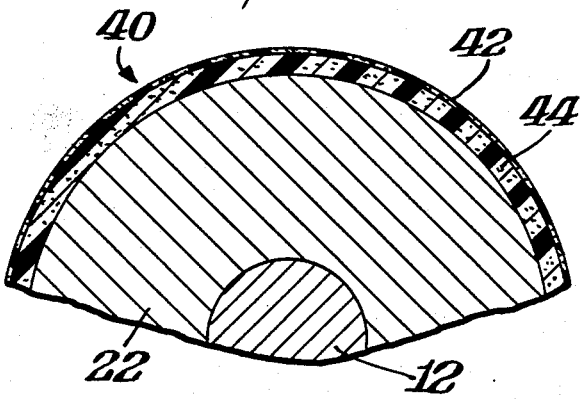
FIG. 5 shows a cross section of the partly porous PTFE covering applied directly to the steel roller without the rubber underlayer.

FIG. 5 shows an embodiment similar to FIG. 4 but in which no silicone rubber buffer layer is employed.

Figure 6A:
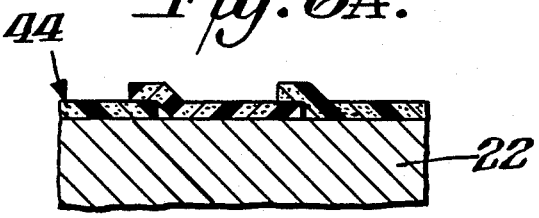
FIGS. 6(A)–6(C) show schematically a method for making the partly porous, partly nonporous or substantially nonporous coating layer by helically wrapping expanded, porous PTFE tape about the steel roller and applying compression forces to the outer surface of the tape to render it nonporous at the outer surface thereof. When sufficient force is applied, the layer becomes substantially nonporous as shown in FIG. 6(C).
Figure 6B:
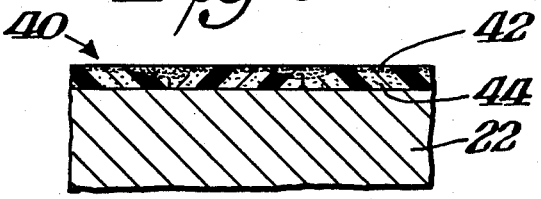
Figure 6C:
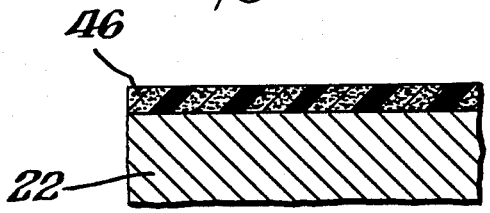

A method of making the partly porous, partly nonporous or substantially nonporous cover layer is depicted schematically in FIGS. 6(A)–6(C). Therein is shown the open celled tape 44 wrapped over the steel roller 22 with edges overlapping. Compressive force applied externally to the tape as indicated by the arrows in FIG. 6(A) compress the tape in such a way as to produce the partly porous region 44 and partly nonporous surface region 42 of covering layer 40 shown in FIG. 6(B). When sufficient force is applied, the layer 46 becomes substantially nonporous as shown in FIG. 6(C).

EXAMPLE 1

Silicone type thermosetting adhesive was coated on the surface of an aluminum roller and an EPTFE film of 80 μm thickness and previously applied with a surface treatment for the surface thereof to be bonded was wound thereover helically so that each turn of the film overlapped slightly to each other, and the overlapped portion was compressed and shaped smoothly by using a roller having a hard surface. Then, the adhesive was hardened in a heated atmosphere to integrally form a non-adhesive EPTFE coating layer on the surface of the roller main body, thereby to manufacture a heat roller. A second aluminum roller was coated on its surface with a commercially available silicone rubber as a buffer layer and the same non-adhesive coating layer as in the heat roller was prepared on the circumferential surface thereof to manufacture a press roller. These rollers were used as the roller fixing device shown in FIG. 1. The hardness on the surface of the press roller was less than 60 and the increase in the hardnes was less than 5 by the Shore A hardness test.

For comparison, a similar roller fixing device was made using a heatshrinkable tube 0.5 mm in thickness made of FEP. The surface hardness of the press roller was greater than 85 by the Shore A hardness test.

Upon setting these roller fixing devices to a fixing station of an electronic copying machine and measuring the time required for starting, the time was about three minutes in the conventional example in which the roller having the heat-shrinkable tube was used, whereas the time could be shortened to about 2 minutes in the case of using the roller device according to this invention. While EPTFE with pore size from 0.05 μm to 50 μm could be used, a pore size between 0.05 μm and 2 μm was preferred.

Further, upon fixing the toner images on copy paper at a temperature of the roller surface of 180° C. and observing the occurrence of off-set, although no off-set was observed in both of the devices, clear copy products with no luster could be obtained in the case of using the roller fixing device according to this invention compared with luster obtained using the conventional roller.

In the case of coating the outer circumferential surface of the heat roller with the open cell cellular plastic film, the coating layer could be provided with electroconductivity by coating with an electroconductive open cell cellular plastic film filled with material having satisfactory electroconductivty.

Preferred electroconductive filler materials include powders of metals, for example, copper, aluminum and nickel, metal oxides, metal nitrides, or inorganic powder such as carbon black or graphite. The filler material may be used singly or by properly combining two or more of the materials, and added in an appropriate amount within such a range as not to impair releasability of the coating layer made of the open cell cellular plastic film to the toner images. Preferably, the range of electroconductivity is between $10^5$–$10^3$ ohm cm. For example, it was preferred to incorporate carbon black within a range from about 1% by weight to about 10% by weight.

In the case where the heat roller main body is made of metal, it is possible to generate heat in the coating layer itself by disposing an electrical insulation layer between the metal roller and the electroconductive coating layer to establish an electrical insulation and by connecting electric contacts at both axial ends of the electroconductive coating layer (not illustrated in the drawing). In this case, while the heat source in the inside of the heat roller main body and the heat source for the coating layer may be used together, electric current can be supplied only to the coating layer inside of the heat roller main body. In the latter case, it is possible to form the heat roller main body with an electric insulation material and eliminate the insulation layer between it and the coating layer.

Furthermore, since the electroconductive coating layer is a heat conductor as well as an electric conductor, it is also possible to form the electroconductive coating layer directly on the outer circumferential surface of the heat roller main body made of metal and to use the heat source only in the inside of the heat roller main body. In this case, the heat conductivity of the coating layer is improved, whereby the heat efficiency of the heat roller can be improved, as compared with the case of disposing the coating layer not containing the electroconductive filler material.

The above-mentioned electroconductive coating layer can be applied not only on the heat roller but also as the coating layer on the press roller. Because there is no static charging on the surface of either roller during rotation of the heat roller and the press roller under press contact, no paper stripping mechanism for stripping copy paper adhered to the surface of the roller is necesssary and no obstacles such as dust are deposited on the surface of either roller, whereby maintenance work can be simplified.

As described above, in a roller fixing device having a plurality of rollers in which adjacent rollers are in contact under pressure to each other, at least one of the rollers is provided at the outer surface thereof with a non-adhesive coating layer, and copy paper carrying toner images thereon is passed between the plurality of rollers to fix the toner images on the paper. Because the coating layer is prepared by winding an open cell cellular plastic film according to this invention, occurrence of the off-set phenomena can be substantially prevented. The heat conductivity can be improved as a result of reducing the thickness of the coating layer, whereby the temperature rise time upon start of the copying can be shortened to attain energy saving.

Further, since the thickness of the non-adhesive coating layer can be reduced without impairing the durability thereof using the plastic film of this invention having excellent mechanical strength, it does not hinder the elasticity of an elastic material disposed as a buffer layer on the press roller, whereby no excessive compression is applied to the toner images, thereby enabling one to obtain copy products which are clear, have no luster and have clear profiles.

The coating layer, when rendered electroconductive according to this invention, can improve the heat conductivity and prevent static charging on the coating layer. In addition, in the case of using the coating layer above as a heat source for the heat roller, because the electroconductive filler material in the coating layer has a self-adjusting performance for the surface temperature, it is possible to substantially eliminate temperature variations and to shorten the temperature rise time upon start of copying or to shorten the temperature recovery time upon contact with the copy paper. This significantly improves the heat efficiency and greatly shortens the time required for the reproduction, as well as enables eliminating the internal heat source for the heat roller and, accordingly, can satisfy the demands of energy saving and rapid reproduction, thereby providing a roller fixing device which is extremely suitable for use in an electronic copying machine.

Because the fixing roller of this invention can be prepared by winding the plastic film around the roller, steps of manufacture can be simplified, providing reduced cost of manufacture.

While the invention has been disclosed herein in connection with certain embodiments and detailed descriptions, it will be clear to one skilled in the art that modifications or variations of such details can be made without deviating from the gist of this invention, and such modifications or variations are considered to be within the scope of the claims hereinbelow.

What is claimed is:

1. A roller fixing device comprsiing a plurality of rollers in which adjacent rollers are in contact under pressure with respect to each other, at least one of said rollers being provided with a resilient material and its outer surface with a thin non-adhesive coating layer of expanded porous polytetrafluoroethylene (PTFE) film, said coating layer rendered nonporous near the region of its external surface but otherwise porous, said coating layer wrapped along axial direction of said roller and copy paper carrying toner images thereon can be passed between said plurality of rollers to thereby fix the toner images on paper.

2. The roller fixing device of claim 1 wherein said coating layer is wrapped helically about said roller.

3. The roller fixing device of claim 1 wherein said coating layer is wrapped longitudinally along axial direction of said roller.

4. The roller fixing device of claim 1 wherein said coating layer contains an electroconductive filler material.

5. The roller fixing device of claim 1 wherein said coating layer is an oriented film.

6. The roller fixing device of claim 1 wherein said coating layer has thickness less than 0.15 millimeters.

7. A method of making a roller fixing device having a plurality of rollers comprising wrapping at least one of said rollers at its outer surface with a non-adhesive coating layer of a porous film of expanded polytetrafluoroethylene where copy paper carrying toner images pass between said plurality of rollers to fix the toner images on the paper.

8. A method as described in claim 7 comprising helically wrapping at least one of said rollers with a non-adhesive coating layer of a porous film of expanded PTFE.

9. A method as described in claim 7 comprising longitudinally wrapping at least one of said rollers with a non-adhesive coating layer of a porous film of expanded PTFE.

* * * * *